US006698434B2

(12) United States Patent
Boldrini

(10) Patent No.: US 6,698,434 B2
(45) Date of Patent: Mar. 2, 2004

(54) METHOD AND UNIT FOR FORMING A TOBACCO BEAD

(75) Inventor: Fulvio Boldrini, Ferrara (IT)

(73) Assignee: G.D Societa' per Azioni, Bologna (IT)

( * ) Notice: Subject to any disclaimer, the term of this patent is extended or adjusted under 35 U.S.C. 154(b) by 61 days.

(21) Appl. No.: 10/083,321

(22) Filed: Feb. 26, 2002

(65) Prior Publication Data

US 2003/0084910 A1 May 8, 2003

(30) Foreign Application Priority Data

Feb. 26, 2001 (IT) ..... BO2001A0102

(51) Int. Cl.[7] ..... A24C 5/28

(52) U.S. Cl. ..... 131/84.4; 131/84.1; 131/84.2; 131/84.3

(58) Field of Search ..... 131/84.4, 84.1, 131/84.2, 84.3, 77, 79, 280, 81.1

(56) References Cited

U.S. PATENT DOCUMENTS 4,037,608 A * 7/1977 Wahle ..... 131/84.4
4,693,262 A 9/1987 Goldbach et al.
4,732,164 A 3/1988 Heitmann

FOREIGN PATENT DOCUMENTS

| | | |
|---|---|---|
| DE | 1432649 | 12/1965 |
| DE | 3631227 | 7/1989 |
| EP | 0399951 | 2/1992 |
| EP | 0 974 276 | 1/2000 |
| FR | 2284288 | 7/1977 |
| GB | 2136265 | 9/1984 |

* cited by examiner

*Primary Examiner*—Dionne A. Walls
(74) *Attorney, Agent, or Firm*—Marshall, Gerstein & Borun LLP

(57) ABSTRACT

A method and unit for forming a tobacco bead, whereby a forming conveyor conveying the tobacco bead cooperates with a pressing device for compacting portions of the tobacco bead equally spaced with a given spacing, and cooperates with a shaving device; and whereby a distance between the pressing device and the forming conveyor is regulated independently of a distance between the shaving device and the forming conveyor, and as a function of a linear travelling speed of the forming conveyor or a physical quantity related to it.

23 Claims, 2 Drawing Sheets

METHOD AND UNIT FOR FORMING A TOBACCO BEAD

The present invention relates to a method of forming a tobacco bead on a cigarette manufacturing machine.

BACKGROUND OF THE INVENTION

Cigarette manufacturing machines normally comprise a tobacco bead forming unit, in turn comprising a forming conveyor for conveying a tobacco bead at a given linear speed; a pressing device for compacting portions, equally spaced with a given spacing, of the tobacco bead conveyed on the forming conveyor; and a shaving device coordinated with the forming conveyor to remove a surplus tobacco portion off the tobacco bead conveyed on the forming conveyor.

To keep the mass of tobacco per unit of length of the tobacco bead within a given acceptance range alongside variations in the humidity of the tobacco and in the speed of the forming conveyor, the distance between the shaving device and the forming conveyor is regulated continuously by keeping the forming conveyor fixed and moving the shaving device vertically, or vice versa.

The function of the pressing device is to form denser portions along the tobacco bead, at the points corresponding to the tips of the cigarettes produced from the bead.

Known pressing devices have been found to have a tendency to produce uneven denser portions along the tobacco bead, which has a negative effect on the overall quality of the cigarettes produced from the bead, by introducing a dispersion factor into the functional characteristics of the cigarettes.

SUMMARY OF THE INVENTION

It is an object of the present invention to provide a method of forming a tobacco bead, designed to eliminate the aforementioned drawbacks, and which at the same time is straightforward and cheap to implement.

According to the present invention, there is provided a method of forming a tobacco bead by means of a forming conveyor for conveying a tobacco bead; a pressing device for compacting portions, equally spaced with a given spacing, of the tobacco bead conveyed on the forming conveyor; and a shaving device coordinated with the forming conveyor and for removing a surplus tobacco portion off the tobacco bead; the method providing for regulating a first distance between said shaving device and said forming conveyor as a function of the characteristics of the tobacco bead; and the method being characterized by estimating a linear travelling speed of the forming conveyor, and regulating a second distance between said pressing device and said forming conveyor as a function of said linear travelling speed of the forming conveyor.

The present invention also relates to a unit for forming a tobacco bead.

According to the present invention, there is provided a unit for forming a tobacco bead, the unit comprising a forming conveyor for conveying a tobacco bead at a given linear speed; a pressing device for compacting portions, equally spaced with a given spacing, of the tobacco bead; a shaving device coordinated with said forming conveyor and for removing a surplus tobacco portion off the tobacco bead; and first regulating means for regulating a first distance between the shaving device and the forming conveyor as a function of the characteristics of the tobacco bead; and the unit being characterized by comprising second regulating means for regulating a second distance between the pressing device and the forming conveyor substantially independently with respect to regulation of the first distance.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
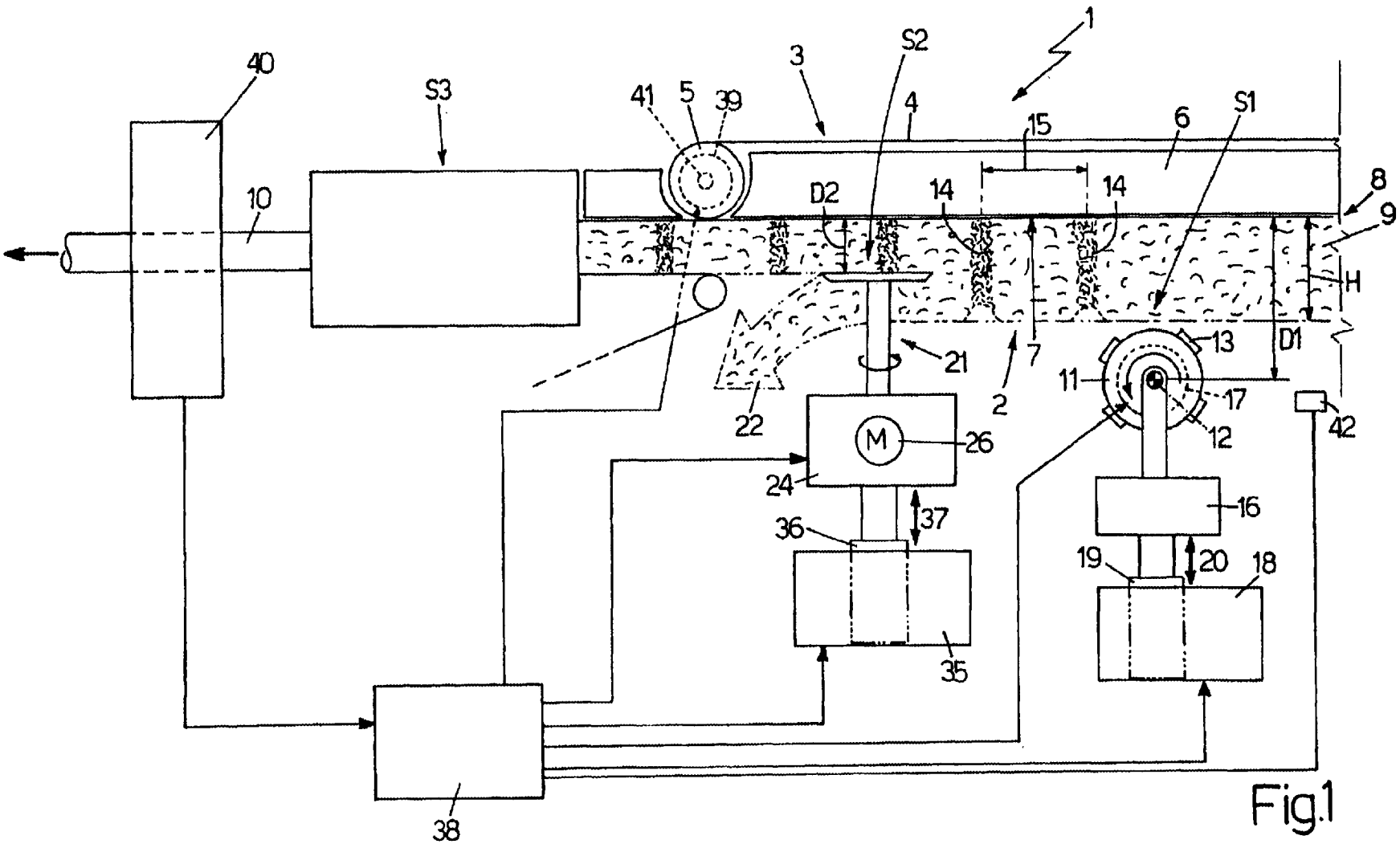
FIG. 1 shows a schematic front view of a unit for forming a tobacco bead in accordance with the present invention.

Number 1 in FIG. 1 indicates as a whole a unit for forming a continuous tobacco bead 2.

Forming unit 1, which forms part of a cigarette manufacturing machine not shown as a whole, comprises a forming conveyor 3 having a suction conveyor belt 4 looped about end rollers 5 (only one shown in FIG. 1). The loop defined by belt 4 encloses a chamber 6, which is connected to a suction source (not shown) and is defined at the bottom by a wall 7 with suction holes (not shown). The bottom branch 8 of belt 4 runs in contact with wall 7 and, to form tobacco bead 2, retains by suction tobacco 9 issuing from a vertical duct (not shown) located beneath branch 8.

Once formed, tobacco bead 2 is fed along a horizontal path through a compacting station S1 and a following shaving station S2 to a wrapping station S3, where a web of paper (not shown) is gummed and wrapped in known manner about tobacco bead 2 to form a continuous cigarette rod 10.

Compacting station S1 comprises a pressure roller 11, which rotates continuously about a horizontal axis 12 perpendicular to the FIG. 1 plane, and comprises a number of peripheral projections 13 for, compacting portions 14, equally spaced with a given spacing 15, of tobacco bead 2. Since the denser portions 14 must correspond to the tips of the cigarettes, the size and phase of spacing 15 depend on the type of cigarettes (not shown) produced from cigarette rod 10.

Pressure roller 11 is fitted to a frame 16, which also houses an electric motor 17 for rotating pressure roller 11 about axis 12. Frame 16 is in turn fitted to a fixed frame 18 by means of a lifting device 19 for regulating the distance D1 between pressure roller 11—in particular, axis 12 of pressure roller 11—and forming conveyor 3 by moving frame 16 in a vertical direction 20 perpendicular to forming conveyor 3.

Figure 2:
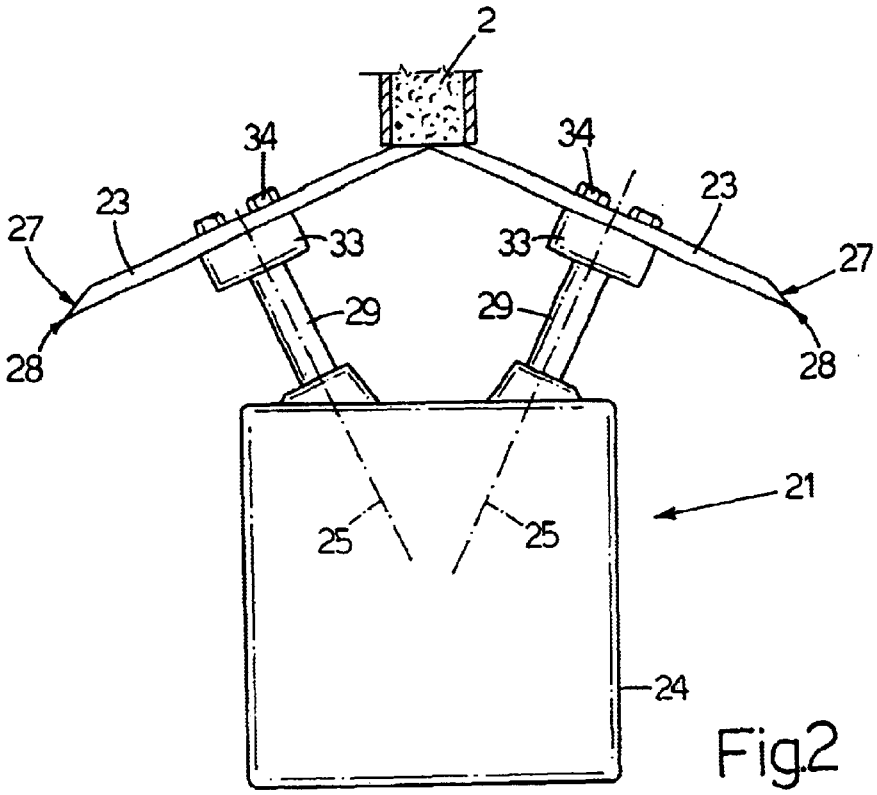
FIG. 2 shows a larger-scale side view of a detail in FIG. 1.
Figure 3:
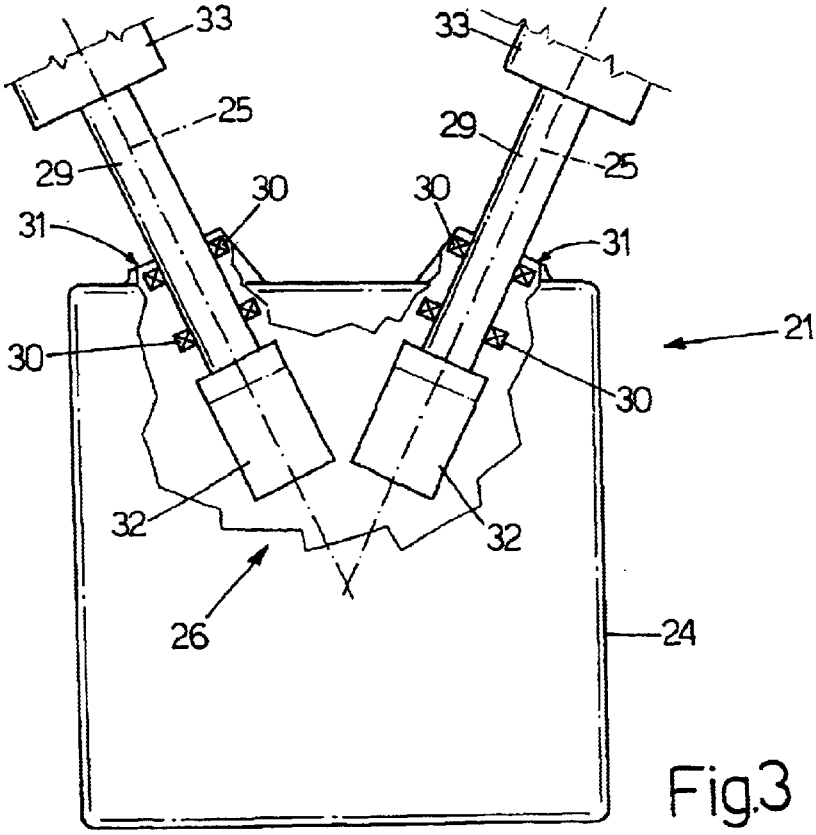
FIG. 3 shows a schematic side view, with parts removed for clarity, of the FIG. 2 detail.

Shaving station S2 comprises a shaving device 21 for producing a tobacco bead 2 of a given height by removing a surplus tobacco portion 22. As shown in FIG. 2, shaving device 21 comprises two known mutually cooperating shaving disks 23 fitted in rotary manner to a frame 24 and rotated by an actuating device 26 about respective axes 25 inclined with respect to the vertical. Shaving disks 23 are defined externally by respective truncated-cone-shaped surfaces 27 having corresponding cutting edges 28, and are positioned with cutting edges 28 substantially tangent to each other so that truncated-cone-shaped surfaces 27 contact tobacco bead 2.

Supporting frame 24 is defined by a box body internally supporting two shafts 29 by means of respective pairs of bearings 30. Shafts 29 are oppositely inclined with respect to the vertical, and project from respective openings 31 in box body 24 to support shaving disks 23. Each shaft 29 is connected to a respective electric motor 32 for rotating shaft 29 about respective axis 25 substantially independently of the other electric motor 32. More specifically, each shaft 29 terminates with a respective flange 33, to which respective shaving disk 23 is fitted by means of screws 34.

Frame 24 is fitted to a fixed frame 35 by means of a lifting device 36 for regulating the distance D2 between shaving device 21 and forming conveyor 3 by moving shaving device 21 in a vertical direction 37 perpendicular to forming conveyor 3.

Forming unit 1 comprises a control unit 38, which controls a motor 39 rotating an end roller 5 of forming conveyor 3 to impart a given linear speed VL to conveyor belt 4. Control unit 38 also controls actuating device 26 to regulate the angular rotation speed of shaving disks 23 about respective axes 25; controls motor 17 to regulate the angular rotation speed VA of pressure roller 11 about axis 12; controls lifting device 19 to regulate distance D1; and controls lifting device 36 to regulate distance D2.

Control unit 38 is connected to a substantially known sensor 40 for continuously measuring the mass of tobacco per unit of length of cigarette rod 10, which mass of tobacco substantially coincides with the mass of tobacco per unit of length of tobacco bead 2 downstream from shaving station S2. Control unit 38 is also connected to a known sensor 41 fitted to motor 39 to indirectly measure the linear speed VL of forming conveyor 3, and is connected to a known sensor 42 for measuring the height H of tobacco bead 2 upstream from shaving station S2.

In actual use, control unit 38 continuously regulates the distance D2 between shaving device 21 and forming conveyor 3 by moving shaving device 21 in vertical direction 37 as a function of the reading of sensor 40 and so as to maintain a substantially constant mass of tobacco per unit of length of cigarette rod 10.

In actual use, control unit 38 also regulates continuously, or at predetermined intervals, the distance D1 between pressure roller 11 and forming conveyor 3 by moving frame 16 in vertical direction 20 so that pressure roller 11 operates in constant conditions at all times. The purpose of regulating distance D1 is to allow pressure roller 11 to compress portions 14 of tobacco bead 2 uniformly, regardless of any variations in tobacco bead 2—in particular in height H of tobacco bead 2—alongside changes in the linear travelling speed VL of forming conveyor 3, changes in environmental conditions, or changes in the operating mode of the vertical duct (not shown). For it to operate uniformly, in fact, pressure roller 11 must obviously be maintained at a distance D1, from forming conveyor 3, depending on the height H of tobacco bead 2 and/or the linear travelling speed VL of forming conveyor 3.

Given the different aims in regulating distances D1 and D2, it is therefore obviously preferable to regulate distance D1 independently of distance D2.

Distance D1 is preferably regulated as a function of the linear travelling speed VL of forming conveyor 3, so that distance D1 is reduced alongside an increase in linear travelling speed VL, and vice versa. As linear speed VL increases, in fact, height H and the density of tobacco bead 2 tend to diminish, and vice versa. In a preferred embodiment, control unit 38 determines linear speed VL from a reading of sensor 41. In an alternative embodiment, control unit 38 estimates linear speed VL by measuring a physical quantity related to linear speed VL, such as the height H of tobacco bead 2, the density of tobacco bead 2 (measured by a known sensor not shown), or the mass of tobacco per unit of length of cigarette rod 10.

Alternatively, distance D1 is regulated as a function of height H of tobacco bead 2, so that distance D1 decreases as height H increases, and vice versa: or distance D1 is regulated as a function of both linear travelling speed VL of forming conveyor 3 and height H of tobacco bead 2.

Control unit 38 also controls motor 17 to regulate the angular rotation speed VA of pressure roller 11 about axis 12 as a function of the linear travelling speed VL of forming conveyor 3, and so as to keep angular speed VA directly proportional to linear speed VL, i.e. maintain a constant ratio K between angular speed VA and linear speed VL, and hence a constant spacing 15 throughout the production of a given type of cigarette (not shown).

Alongside a change in the type of cigarette (not shown) being produced, control unit 38 accordingly changes the ratio K between angular speed VA and linear speed VL to alter the spacing 15 between two successive portions 14 of tobacco, and so adapt spacing 15 to the new type of cigarette.

In an alternative embodiment not shown, a single electric motor drives forming conveyor 3 at linear speed VL by means of a first mechanical transmission, and drives pressure roller 11 at angular speed VA by means of a second mechanical transmission, and mechanical or electromechanical control means are provided for adjusting ratio K between angular speed VA and linear speed VL by varying the velocity ratio of the second transmission.

Operation of pressure roller 11 can therefore be adapted rapidly to different types of cigarettes (not shown) being produced, with no need to change any part of forming unit 1.

In the preferred embodiment shown in the accompanying drawings, control unit 38 activates the two electric motors 32 to impart a respective given angular speed to each shaving disk 23. More specifically, control unit 38 activates the two electric motors 32 to impart the same angular speed or two different angular speeds to the two shaving disks 23. In general, the angular speed of each shaving disk 23 is determined by control unit 38 as a function of the density of tobacco bead 2, as a function of the mass of tobacco per unit of length of cigarette rod 10, and/or as a function of the linear travelling speed VL of forming conveyor 3.

It should be pointed out that using two separate independent electric motors 32 provides for an extremely compact, low-cost structure of shaving device 21, as well as for precise, continuous, independent adjustment of the rotation speeds of shaving disks 23.

What is claimed is:

1. A method of forming a tobacco bead by means of a forming conveyor (3) for conveying the tobacco bead (2); a pressing device (11) for compacting portions (14) of the tobacco bead (2) equally spaced with a given spacing (15); and a shaving device (21) coordinated with the forming conveyor (3) and for removing a surplus tobacco portion (22) off the tobacco bead (2); the method providing for regulating a first distance (D2), between said shaving device (21) and the forming conveyor (3) as a function of the characteristics of the tobacco bead (2); and the method being characterized by regulating a second distance (D1) between the pressing device (11) and the forming conveyor (3), and regulating the second distance (D1) independently of the first distance (D2).

2. The method of claim 1, and further regulating said first distance (D2) by means of a first actuator (36), and regulating said second distance (D1) by means of a second actuator (19) independent of said first actuator (36).

3. The method of claim 1, and further estimating a linear travelling speed (VL) of the forming conveyor (3), and regulating a second distance (D1) between said pressing device (11) and said forming conveyor (3) as a function of said linear travelling speed (VL) of the forming conveyor (3).

4. The method of claim 3, and further reducing said second distance (D1) alongside an increase in said linear travelling speed (VL) of the forming conveyor (3).

5. The method of claim 3, and further estimating the linear travelling speed (VL) of said forming conveyor (3) by direct measurement of the linear travelling speed (VL).

6. The method of claim 3, and further estimating the linear travelling speed (VL) of said forming conveyor (3) by measuring a physical quantity related to the linear travelling speed (VL).

7. The method of claim 6, and further estimating the linear travelling speed (VL) of said forming conveyor (3) by means of a measurement of said tobacco bead (2).

8. The method of claim 7, and further estimating the linear travelling speed (VL) of said forming conveyor (3) by measuring a height (H) of said tobacco bead (2).

9. The method of claim 7, and further estimating the linear travelling speed (VL) of said forming conveyor (3) by measuring the density of said tobacco bead (2).

10. The method of claim 7, and further estimating the linear travelling speed (VL) of said forming conveyor (3) by measuring the mass of tobacco per unit of length of said tobacco bead (2).

11. The method of claim 1, and further measuring the density of said tobacco bead (2), and regulating said second distance (D1) as a function of said density of the tobacco bead (2).

12. The method of claim 11, and further increasing said second distance (D1) alongside an increase in said density of the tobacco bead (2).

13. The method of claim 1, and further measuring, downstream from said shaving device (21), a mass of tobacco per unit of length of said tobacco bead (2), and regulating said second distance (D1) as a function of said mass of tobacco per unit of length of the tobacco bead (2).

14. The method of claim 13, and further increasing said second distance (D1) alongside an increase in said mass of tobacco per unit of length of the tobacco bead (2).

15. The method of claim 1, and further measuring a height (H) of said tobacco bead (2), and regulating said second distance (D1) as a function of said height (H) of the tobacco bead (2).

16. The method of claim 15, and further increasing said second distance (D1) alongside a reduction in said height (H) of the tobacco bead (2).

17. A unit for forming a tobacco bead, the unit (1) comprising a forming conveyor (3) for conveying the tobacco bead (2) at a given linear speed (VL); a pressing device (11) for compacting portions (14), equally spaced with a given spacing (15), of the tobacco bead (2); a shaving device (21) coordinated with said forming conveyor (3) and for removing a surplus tobacco portion (22) off the tobacco bead (2); and first regulating means (36) for regulating a first distance (D2) between the shaving device (21) and the forming conveyor (3) as a function of the characteristics of the tobacco bead (2); and wherein unit (1) comprises a second regulating means (19) for regulating a second distance (D1) between the pressing device (11) and the forming conveyor (3) substantially independently with respect to said first regulating means (36).

18. The unit of claim 17, wherein said first regulating means (36) comprise a first actuator (36), and said second regulating means (19) comprise a second actuator (19) independent of the first actuator (36).

19. The unit of claim 17, and further comprising estimating means (38) for estimating a linear travelling speed (VL) of the forming conveyor (3); said second regulating means (19) regulating said second distance (D1) as a function of said linear travelling speed (VL) of the forming conveyor (3).

20. The unit of claim 19, and further comprising sensor means (41) for measuring said linear travelling speed (VL) of the forming conveyor (3); said estimating means (38) being connected to the sensor means (41) to estimate the linear travelling speed (VL) of said forming conveyor (3) by direct measurement of the linear travelling speed (VL).

21. The unit of claim 19, and further comprising further sensor means (40; 42) for measuring a physical quantity related to said linear travelling speed (VL) of the forming conveyor (3); said estimating means (38) being connected to the further sensor means (40; 42) to estimate the linear travelling speed (VL) of said forming conveyor (3) by means of the measurement of said physical quantity related to the linear travelling speed (VL).

22. The unit of claim 21, wherein said further sensor means (40; 42) effect a measurement of said tobacco bead (2).

23. The unit of claim 22, wherein said further sensor means (42) measure a vertical height (H) of said tobacco bead (2).

* * * * *

UNITED STATES PATENT AND TRADEMARK OFFICE

CERTIFICATE OF CORRECTION

PATENT NO. : 6,698,434 B2
DATED : March 2, 2004
INVENTOR(S) : Boldrini

It is certified that error appears in the above-identified patent and that said Letters Patent is hereby corrected as shown below:

Column 4,
Line 58, “the” should be -- said --
Line 61, “said” should be -- the --

Signed and Sealed this

Second Day of November, 2004

JON W. DUDAS
*Director of the United States Patent and Trademark Office*